US005236525A

United States Patent [19]

Anton

[11] Patent Number: 5,236,525

[45] Date of Patent: Aug. 17, 1993

[54] METHOD OF THERMALLY PROCESSING SUPERPLASTICALLY FORMED ALUMINUM-LITHIUM ALLOYS TO OBTAIN OPTIMUM STRENGTHENING

[75] Inventor: Claire E. Anton, Long Beach, Calif.

[73] Assignee: Rockwell International Corporation, Seal Beach, Calif.

[21] Appl. No.: 829,819

[22] Filed: Feb. 3, 1992

[51] Int. Cl.[5] ..... C22F 1/04

[52] U.S. Cl. ..... 148/564; 148/694; 148/698; 148/415; 148/437; 420/902

[58] Field of Search ..... 148/564, 694, 698, 415, 148/437; 420/902

[56] References Cited

U.S. PATENT DOCUMENTS 4,874,440 10/1989 Sawtell et al. ..... 148/564

5,019,183 5/1991 Martin ..... 148/564

*Primary Examiner*—R. Dean

*Assistant Examiner*—Robert R. Koehler

*Attorney, Agent, or Firm*—Terrell P. Lewis; Charles T. Silberberg

[57] ABSTRACT

Optimum strengthening of a superplastically formed aluminum-lithium alloy structure is achieved via a thermal processing technique which eliminates the conventional step of solution heat-treating immediately following the step of superplastic forming of the structure. The thermal processing technique involves quenching of the superplastically formed structure using static air, forced air or water quenching.

8 Claims, 3 Drawing Sheets

| Orien-tation | Sol'n Heat Treat Temp. (°F/°C) | Quench Type | Aging Temp. (°F/°C) | Aging Time (Hrs.) | Fty (ksi) | Ftu (ksi) | Elong. (%) | Fracture Strain (%) |
|---|---|---|---|---|---|---|---|---|
| L | *950/510 | Water | 356/180 | 48 | 53.1 | 67.9 | 5.2 | 6.3 |
| T | *950/510 | Water | 356/180 | 48 | 52.8 | 67.4 | 4.9 | 6.5 |
| L | *950/510 | Water | 356/180 | 24 | 53.6 | 68.4 | 3.2 | 4.6 |
| T | *950/510 | Water | 356/180 | 24 | 47.7 | 61.0 | 7.7 | 8.6 |
| L | *950/510 | Slow Air | 356/180 | 24 | 53.7 | 66.4 | 2.1 | 4.4 |
| T | *950/510 | Slow Air | 356/180 | 24 | 48.0 | 61.8 | 6.5 | 7.7 |
| L | *950/510 | Forced Air | 356/180 | 48 | 48.1 | 62.6 | 5.6 | 9.0 |
| T | *950/510 | Forced Air | 356/180 | 48 | 46.6 | 60.9 | 4.9 | 7.8 |
| L | *950/510 | Forced Air | 356/180 | 24 | 47.5 | 59.3 | 3.7 | 7.8 |
| L | 1010/545 | Water | 356/180 | 48 | 52.0 | 64.9 | 2.4 | 5.7 |
| T | 1010/545 | Water | 356/180 | 48 | 45.9 | 58.1 | 2.9 | 8.1 |
| L | 1040/560 | Water | 356/180 | 48 | 53.3 | 63.4 | 2.3 | 9.0 |
| T | 1040/560 | Water | 356/180 | 48 | 43.2 | 57.9 | 7.2 | 8.4 |

FIG. 3

| Orien-tation | Sol'n Heat Treat Temp. (°F/°C) | Quench Type | Aging Temp. (°F/°C) | Aging Time (Hrs.) | Fty (ksi) | Ftu (ksi) | Elong. (%) | Fracture Strain (%) |
|---|---|---|---|---|---|---|---|---|
| L | *950/510 | Water | 356/180 | 48 | 68.7 | 76.1 | 1.48 | 4.7 |
| T | *950/510 | Water | 356/180 | 48 | 58.0 | 68.5 | 4.3 | 9.1 |
| L | *950/510 | Water | 356/180 | 24 | 63.9 | 75.2 | 3.1 | 3.9 |
| T | *950/510 | Water | 356/180 | 24 | 52.5 | 63.6 | 5.7 | 8.3 |
| L | *950/510 | Slow Air | 356/180 | 24 | 52.0 | 64.5 | 1.8 | 5.9 |
| T | *950/510 | Slow Air | 356/180 | 24 | 48.7 | 60.9 | 1.7 | 7.6 |
| L | 1010/545 | Water | 356/180 | 48 | 48.0 | 62.0 | 3.8 | 4.9 |
| T | 1010/545 | Water | 356/180 | 48 | 48.9 | 63.4 | 4.0 | 7.6 |
| L | 1040/560 | Water | 356/180 | 48 | 44.1 | 57.6 | 1.9 | 6.8 |
| T | 1040/560 | Water | 356/180 | 48 | 46.3 | 58.8 | 6.4 | 8.0 |

FIG. 4

METHOD OF THERMALLY PROCESSING SUPERPLASTICALLY FORMED ALUMINUM-LITHIUM ALLOYS TO OBTAIN OPTIMUM STRENGTHENING

The invention described herein was made in the performance of work under NASA Contract No. 18590 and is subject to the provisions of Section 305 of the National Aeronautics and Space Act of 1958 (42 U.S.C. 2457).

BACKGROUND OF THE INVENTION

1. Field of the Invention

The present invention relates to techniques for achieving optimum strengthening of aluminum-lithium alloys following forming, and more particularly to age hardening heat treatments for aluminum lithium alloys which have been superplastically formed.

2. Background of the Invention

In the aerospace industry, it has been generally recognized that one of the most effective ways to reduce the weight of a craft is to reduce the density of the materials used in its construction.

For purposes of reducing aluminum alloy densities up to 20%, lithium additions have been made. It is known that such aluminum-lithium alloys can offer high strength and stiffness, and still exhibit good corrosion-resistance properties.

However, the addition of lithium to aluminum alloys is not without problems. For example, it has been found that alloys of this kind have suffered from a reduction in such properties as fracture toughness and ductility. For aircraft parts, it is particularly important that lithium-containing alloys exhibit sufficiently high fracture toughness and strength properties, as well as high ductility.

Historically, thermomechanical processing of aluminum alloys has involved plastic stretching of about 3% after solution treatment and before aging to produce optimum properties in the product formed. Such prestraining has been shown to provide an increase in dislocation density which results in the matrix. This procedure has also been used with aluminum-lithium alloys to provide for maximum strengthening response during artificial aging.

Aluminum-lithium materials provide for a low density high-strength system of alloys that can provide significant weight savings for aircraft structures. The weight savings obtained with these alloys can be enhanced through the use of superplastic forming to minimize part manufacturing and life cycle cost, and weight. Many of the aluminum-lithium alloys exhibit substantial superplasticity if properly processed, which permits dramatic improvements in the range of complex parts and configurations that can be produced. As a result, SPF processing of aluminum-lithium alloys has been pursued by many organizations around the world.

Peak strength is achieved in aluminum-lithium alloys through thermomechanical processing techniques. However, parts fabricated using the superplastic forming process are not amenable to pre-stretching before aging due to their complexity of design. Superplastic forming inherently involves deformation of sheet metal at temperatures well in excess of those used for natural aging of the alloy. Generally, solution treatment and artificial aging is required after the SPF processing to achieve maximum strength. However, in order to achieve peak strength in the material, it would be necessary to conduct prestraining on the net-shaped part, a step which is nearly impossible. Thus the inventor has approached solving the problem of strengthening the SPF-processed aluminum lithium alloy sheet metal parts by using novel and unobvious non-standard thermal treatment.

In the past, efforts have been made to establish thermal treatments for SPF-processed 8091 Al-Li materials in order to achieve the maximum allowable strength and ductility after superplastic forming. These treatments utilized solution treatment (followed by quenching) and artificial aging after the forming process had been completed (see FIG. 1 and the description thereof below). This study generated a standard thermal processing treatment for the alloy that accepted the limitations of configuration tolerances and strength properties.

In this earlier work, solution treatment and aging treatment parameters were established which were considered suitable for the processing of structures for aerospace applications. While the strength levels produced were not as high as those obtained with prestraining, they were nonetheless considered suitable for use in the application of the high specific stiffness alloy. In this work, the optimum heat treatment included solution treatment after forming, followed by water quenching, and then isothermal aging to peak strength.

However, it has been noted that standard solution treatment parameters in aluminum-lithium alloys can result in significant solute depletion resulting in higher density for the alloys and loss in maximum achievable strength. Historically, there has not been a measurable amount of solute depletion due to the superplastic forming process. Thus all depletion in the materials are due to reactions during solution heat treatment.

No other heat treatment processes for aluminum-lithium materials have since been developed which have yielded maximum strengthening responses for the materials following superplastic forming—until the discovery embodied by this invention.

OBJECTS AND SUMMARY OF THE INVENTION

It is therefore an object of the present invention to provide novel methods for heat treating aluminum lithium alloys after they are superplastically formed which will overcome all the deficiencies of the methods currently known in the art while permitting attainment of yield strengths of at least 50 ksi.

Another object of the present invention is to provide a novel method for heat treating superplastically formed 2090 and 8090 aluminum lithium alloys to achieve high yield strengths of at least 50 ksi in which the alloys are subjected to quenching via air or water cooling directly upon removal from the forming process.

These and other objects are accomplished by bathing the superplastically formed alloy parts in a rapid-cooling medium immediately following superplastic forming of the parts. More particularly, the invention resides in heat treatment techniques which enable achieving strength levels of at least 50 ksi yield strength for superplastically formed parts produced from the 2090 and 8090 aluminum-lithium alloys. The heat treatment techniques embraced by the invention include both air cooling and water cooling of the treated parts following superplastic forming, with air cooling being the quenching method of preference.

BRIEF DESCRIPTION OF THE DRAWINGS

FIGS. 3 and 4 are tables showing the correlation between various heat treatment parameters and the tensile responses of coupons tested for the 8090 and 2090 aluminum-lithium alloy materials.

DETAILED DESCRIPTION OF THE INVENTION

Figure 1:
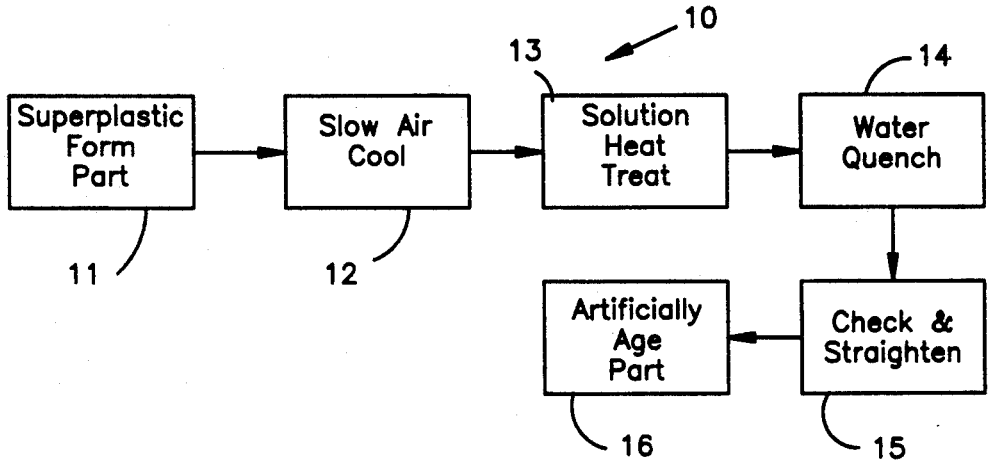
FIG. 1 is a block diagram showing the steps embraced by the conventional methodology for heat-treating superplastically formed aluminum and aluminum-lithium alloy materials to achieve maximum strength.

Referring now to FIG. 1, the conventional process is seen to include a first step 11 of forming the alloy into a component using a superplastic forming (SPF) process, a second step 12 of removing the SPF-formed component from tooling used in the SPF equipment and allowing it to air cool, a third step 13 of solution heat-treating the SPF-formed alloy component, a fourth step 14 of subjecting the SPF-formed component to a water quench, a fifth step 15 of checking and straightening the quenched component, and a sixth step 16 of artificially aging the component.

Figure 2:
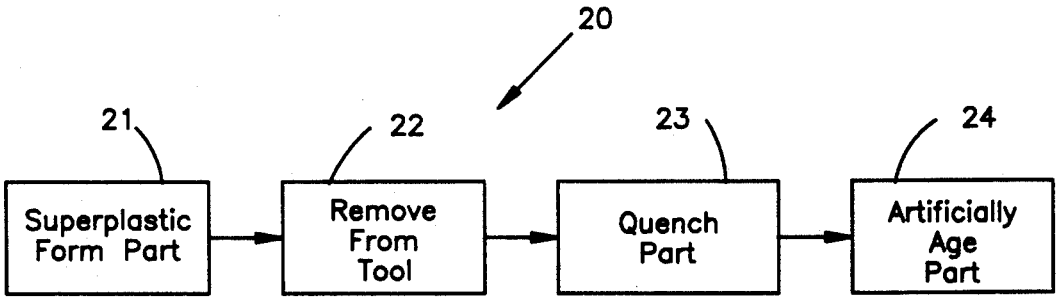
FIG. 2 is a block diagram showing the steps embraced by the process of the present invention for treating aluminum-lithium alloy materials to optimize maximum strength following superplastic forming.

FIG. 2 illustrates the method of the present invention, which only requires a first step 21 of forming the alloy into a component using a superplastic forming (SPF) process, a second step 22 of removing the SPF-formed component from the tooling used in the SPF equipment, a third step 23 of quenching the SPF-formed component, and a fourth step 24 of artificially aging the SPF-formed component.

In the method according to the present invention, superplastic forming followed by a quench eliminates the necessity for subsequent solution heat treatment prior to aging to obtain desired properties, while also eliminating re-working or bench straightening due to distortion in the quench after the solution heat treatment cycle.

The 2090 and 8090 aluminum-lithium alloy materials used in the development of the inventive techniques for achieving optimum strengthening were production quality sheets obtained from such commercial sources as Alcoa and British Alcan. These sheets of material included the following chemistry (in weight percent):

| Alloy | Li | Cu | Mg | Zr | Fe | Si | Al |
|---|---|---|---|---|---|---|---|
| 8090 | 2.8 | 1.3 | 0.7 | 0.12 | 0.05 | 0.02 | Bal. |
| 2090 | 2.2 | 2.7 | — | 0.10 | 0.06 | 0.04 | Bal. |

These aluminum-lithium alloy materials were especially processed at the mills for superplastic forming, and then superplastically formed to obtain box-shaped, flat-bottomed test pans. The superplastic forming of the test pans was carried out at a temperature of 510° C. using a back pressure of 350 psi to prevent cavitation. These superplastically-formed materials were then cooled by various quenching techniques, such as by water quenching, static air cooling, or forced air cooling, to provide for an evaluation of the quench rate effects on the age hardened properties.

The present invention is concerned with heat treatment parameters of the 8090 and 2090 aluminum-lithium alloys after superplastic forming. It is to be noted that this invention is discussed in terms of (in comparison with) heat treatment parameters for sheets of alloy material received from the mill (i.e., "as-received material").

Since 510° C. was used as the superplastic forming temperature, the superplastically-processed parts were cooled directly from the forming operation. This procedure was considered to be of particular interest since it essentially eliminated an additional solution heat treatment.

Following solution heat treatment, artificial aging was performed on both alloys after forming and quenching. The strengthening kinetics of the alloys during different heat treatments were monitored using Rockwell Superficial Hardness tests (30T scale). The samples were exposed to artificial aging temperatures for a maximum of 100 hours. Hardness measurements were taken periodically and tensile testing was conducted for the best thermal treatments. All isothermal artificial aging treatments were conducted in air using the same Marshall cylindrical tube furnace with temperature control maintained to within +1° C.

FIG. 3 shows the results of selected tensile tests for the SPF-treated 8090 aluminum-lithium alloy, while FIG. 4 shows the results of selected tensile tests for the SPF-treated 2090 aluminum-lithium alloy.

The microstructure after superplastic deformation is that of a fully-recrystallized Aluminum alloy, and is consistent with observations made for the Aluminum-lithium alloy containing Zr. The microstructural evolution appeared to be that of continuous dynamic recrystallization in which the deformation causes the sub-grain boundaries to overcome the pinning effect of the $Al_3Zr$ particles, and the growth of these sub-grains is accompanied by the development of high angle boundaries resulting in a fully recrystallized material. While the starting material may have a high degree of warm or cold work, the high temperature deformation causes recovery and recrystallization. The strength of the formed (forming performed at 510° C.), quenched and aged 8090 and 2090 alloy systems (aging in the range of 150° C. to 180° C.) resulted in high strength products with acceptable ductilities. The Form-Quenched-Artificial Age process of the present invention provides for minimal solute depletion, maximum configuration tolerances after forming while providing for excellent strengthening response in the materials.

While certain representative embodiments and details have been shown for the purpose of illustrating the invention, it will be apparent to those skilled in this art that various changes and modifications may be made therein without departing from the spirit or scope of this invention.

What I claim is:

1. A method of optimizing the tensile strength of a structure formed from superplastically formed aluminum-lithium alloy materials, comprising:

quenching the structure immediately following the process of superplastic forming so that the conventional step of solution heat-treating said structure is eliminated, and without further working of said structure artificially aging said quenched structure at a temperature of about 180° for a period of time long enough to achieve a tensile strength of at least 50 ksi.

2. The method of claim 1, wherein said step of quenching consists of water quenching.

3. The method of claim 1, wherein said step of quenching consists of static air cooling.

4. The method of claim 1, wherein said step of quenching consists of forced air cooling.

5. The method of claim 1, wherein said alloy is 2090 aluminum-lithium material.

6. The method of claim 5, wherein said period of time is at least approximately 24 hours.

7. The method of claim 1, wherein said alloy is 8090 aluminum-lithium material.

8. The method of claim 7, wherein said period of time is at least approximately 24 hours.

* * * * *